US009821594B2

(12) United States Patent
Whaley

(10) Patent No.: US 9,821,594 B2
(45) Date of Patent: Nov. 21, 2017

(54) LOCKING RING METAL

(71) Applicant: U.S. Ring Binder, L.P., St. Louis, MO (US)

(72) Inventor: Paul Whaley, Herculaneum, MO (US)

(73) Assignee: U.S. Ring Binder, L.P., St. Louis, MO (US)

( * ) Notice: Subject to any disclaimer, the term of this patent is extended or adjusted under 35 U.S.C. 154(b) by 353 days.

(21) Appl. No.: 14/454,118

(22) Filed: Aug. 7, 2014

(65) Prior Publication Data

US 2014/0348570 A1 Nov. 27, 2014

Related U.S. Application Data

(63) Continuation-in-part of application No. 13/827,559, filed on Mar. 14, 2013.

(60) Provisional application No. 61/727,944, filed on Nov. 19, 2012.

(51) Int. Cl.

| | |
|---|---|
| ***B42F 3/02*** | (2006.01) |
| ***B42F 13/02*** | (2006.01) |
| ***B42F 13/00*** | (2006.01) |
| ***B42F 13/20*** | (2006.01) |
| ***B42F 13/36*** | (2006.01) |
| ***B42F 13/26*** | (2006.01) |

(52) U.S. Cl.

CPC ..... *B42F 13/36* (2013.01); *B42F 13/26* (2013.01)

(58) Field of Classification Search

CPC .. B42F 3/02; B42F 13/02; B42F 13/00; B42F 13/20

USPC ..... 402/19, 20, 26, 31, 35, 41, 44

See application file for complete search history.

(56) References Cited

U.S. PATENT DOCUMENTS

| | | | |
|---|---|---|---|
| 5,180,247 | A | 1/1993 | Yu |
| 5,354,142 | A | 10/1994 | Yu |
| 5,476,335 | A | 12/1995 | Whaley |
| 5,611,633 | A | 3/1997 | Whaley |
| 5,816,729 | A | 10/1998 | Whaley |
| 5,924,811 | A | 7/1999 | To et al. |
| 5,957,611 | A | 9/1999 | Whaley |
| 6,062,760 | A | 5/2000 | Whaley |
| 6,270,279 | B1 | 8/2001 | Whaley |
| 6,749,357 | B2 | 6/2004 | Cheng |
| 6,840,695 | B2 | 1/2005 | Horn |
| 6,916,134 | B2 | 7/2005 | Wong |

(Continued)

FOREIGN PATENT DOCUMENTS

| | | | |
|---|---|---|---|
| CA | 2493203 | A1 | 9/2005 |
| CN | 1709711 | A | 12/2005 |

(Continued)

*Primary Examiner* — Justin V Lewis

(74) *Attorney, Agent, or Firm* — Polster Lieder

(57) ABSTRACT

A locking ring metal (10) includes binder rings (12, 14, 16) each formed by a pair of complementary shaped binder ring halves. Each ring half has an end attached to a frame (18, 20). The frames are movable relative to each other to open and close the binder rings. The frames are installed in housing (22) at one end of which a trigger (11) is mounted. A travel bar (34) installed within the housing above the frames and not connected to the trigger includes blocking elements (50) which, when in position, prevent movement of the frames to lock the binder rings in their closed position. A coil spring (48) attached to the travel bar and housing biases the travel bar in the direction to open the binder rings.

20 Claims, 15 Drawing Sheets

(56) References Cited

U.S. PATENT DOCUMENTS

| | | | |
|---|---|---|---|
| 6,974,273 | B2 | 12/2005 | Cheng |
| 7,404,685 | B2 | 7/2008 | Cheng |
| 7,513,708 | B2 | 4/2009 | Cheng et al. |
| 7,524,128 | B2 | 4/2009 | Cheng |
| 7,534,064 | B2 | 5/2009 | Cheng |
| 7,549,817 | B2 | 6/2009 | Cheng et al. |
| 7,597,498 | B2 | 10/2009 | Cheng |
| 7,600,939 | B2 | 10/2009 | Liu et al. |
| 7,648,302 | B2 | 1/2010 | Zhang et al. |
| 7,654,764 | B2 | 2/2010 | To |
| 7,661,898 | B2 | 2/2010 | Ng et al. |
| 7,661,899 | B2 | 2/2010 | Lin |
| 7,665,926 | B2 | 2/2010 | Cheng |
| 7,674,062 | B2 | 3/2010 | Horn |
| 7,726,897 | B2 | 6/2010 | To et al. |
| 7,731,441 | B2 | 6/2010 | Ng et al. |
| 7,744,300 | B2 | 6/2010 | Cheng et al. |
| 7,748,922 | B2 | 7/2010 | Cheng |
| 7,758,271 | B2 | 7/2010 | Cheng |
| 7,762,734 | B2 | 7/2010 | Cheng |
| 7,878,729 | B2 | 2/2011 | Cheng |
| 7,891,901 | B2 | 2/2011 | Cheng et al. |
| 7,950,867 | B2 | 5/2011 | Lin |
| 8,002,488 | B2 | 8/2011 | Cheng |
| 8,038,361 | B2 | 10/2011 | Cheng et al. |
| 8,043,018 | B2 | 10/2011 | Cheng |
| 8,047,737 | B2 | 11/2011 | Pi et al. |
| 8,052,343 | B2 | 11/2011 | Zhang et al. |
| 8,162,556 | B2 | 4/2012 | Cheng et al. |
| 8,186,899 | B2 | 5/2012 | Ng et al. |
| 8,393,819 | B2 | 3/2013 | Warmus |
| 2003/0103796 | A1 | 6/2003 | To et al. |
| 2003/0103798 | A1 | 6/2003 | Cheng et al. |
| 2005/0207826 | A1 | 9/2005 | Cheng et al. |
| 2005/0271459 | A1 | 12/2005 | To et al. |
| 2006/0008318 | A1 | 1/2006 | Ng |
| 2006/0024124 | A1 | 2/2006 | Cheng |
| 2006/0153630 | A1 | 7/2006 | Cheng |
| 2007/0048071 | A1 | 3/2007 | Li et al. |
| 2007/0048072 | A1 | 3/2007 | To et al. |
| 2007/0048077 | A1 | 3/2007 | Cheng et al. |
| 2007/0048078 | A1 | 3/2007 | Cheng |
| 2007/0048079 | A1 | 3/2007 | Ng |
| 2007/0048080 | A1 | 3/2007 | Cheng |
| 2007/0086836 | A1 | 4/2007 | Cheng |
| 2007/0134053 | A1 | 6/2007 | Haneda et al. |
| 2007/0134054 | A1 | 6/2007 | Li |
| 2007/0140778 | A1 | 6/2007 | Lin |
| 2007/0140779 | A1 | 6/2007 | Cheng |
| 2007/0140780 | A1* | 6/2007 | Petrie ..... B42F 13/26 402/41 |
| 2007/0160415 | A1 | 7/2007 | To et al. |
| 2007/0160416 | A1 | 7/2007 | Cheng |
| 2007/0223990 | A1 | 9/2007 | Li et al. |
| 2007/0283542 | A1 | 12/2007 | Cheng |
| 2008/0050171 | A1 | 2/2008 | Cheng et al. |
| 2008/0075526 | A1 | 3/2008 | Ng et al. |
| 2008/0075527 | A1 | 3/2008 | Pi et al. |
| 2008/0080925 | A1 | 4/2008 | Cheng |
| 2008/0080926 | A1 | 4/2008 | Liu et al. |
| 2008/0085145 | A1 | 4/2008 | To et al. |
| 2008/0124166 | A1 | 5/2008 | Zhang et al. |
| 2008/0170905 | A1 | 7/2008 | Cheng |
| 2008/0175651 | A1 | 7/2008 | Cheng |
| 2008/0175652 | A1 | 7/2008 | Cheng et al. |
| 2008/0267691 | A1 | 10/2008 | Cheng |
| 2008/0286035 | A1 | 11/2008 | To |
| 2008/0298883 | A1 | 12/2008 | Cheng |
| 2009/0035053 | A1 | 2/2009 | Pi et al. |
| 2009/0041532 | A1 | 2/2009 | Cheng et al. |
| 2009/0060631 | A1* | 3/2009 | To ..... B42F 13/26 402/38 |
| 2009/0116896 | A1 | 5/2009 | To |
| 2009/0169287 | A1 | 7/2009 | Cheng |
| 2009/0274508 | A1 | 11/2009 | Zhang et al. |
| 2009/0274509 | A1 | 11/2009 | Liu et al. |
| 2009/0285623 | A1 | 11/2009 | Whaley |
| 2010/0003070 | A1 | 1/2010 | Cheng |
| 2010/0054850 | A1 | 3/2010 | Lin |
| 2010/0166490 | A1 | 7/2010 | Cheng et al. |
| 2010/0166491 | A1 | 7/2010 | Lin |
| 2010/0232867 | A1 | 9/2010 | Ng et al. |
| 2010/0278583 | A1 | 11/2010 | Cheng |
| 2011/0085846 | A1 | 4/2011 | Cheng et al. |
| 2011/0110703 | A1 | 5/2011 | Cheng et al. |
| 2011/0170942 | A1* | 7/2011 | Huang ..... B42F 13/26 402/31 |
| 2011/0305500 | A1 | 12/2011 | To |
| 2011/0311300 | A1 | 12/2011 | To |
| 2011/0311301 | A1 | 12/2011 | To |
| 2011/0311302 | A1 | 12/2011 | To |
| 2012/0051830 | A1 | 3/2012 | Pi et al. |
| 2012/0230755 | A1 | 9/2012 | Ng et al. |
| 2013/0061447 | A1 | 3/2013 | Pigg, Jr. et al. |

FOREIGN PATENT DOCUMENTS

| | | |
|---|---|---|
| CN | 1727206 A | 2/2006 |
| CN | 1978214 A | 6/2007 |

* cited by examiner

FIG. 24
PRIOR ATR
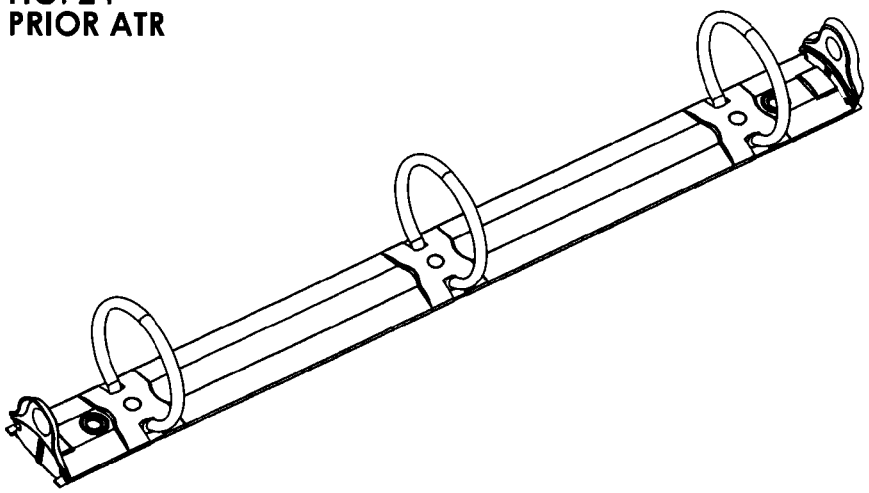
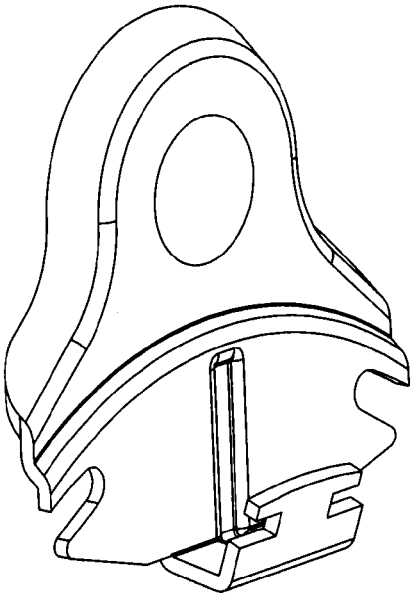
FIG. 25
PRIOR ART

LOCKING RING METAL

CROSS REFERENCE TO RELATED APPLICATIONS

This application is a continuation-in-part of U.S. patent application Ser. No. 13/827,559 filed Mar. 14, 2013, which is based on and claims the benefit of U.S. provisional patent application 61/727,944 filed Nov. 19, 2012.

STATEMENT REGARDING FEDERALLY SPONSORED RESEARCH OR DEVELOPMENT

N/A

BACKGROUND OF THE INVENTION

This invention relates to locking ring metals for use in binders; and, more particularly, to an improved locking ring metal.

As is well-known in the art, the purpose of a ring metal used in binders is to hold material, typically hole-punched sheets of paper or the like so the material is readily available to a user and easily transported from one place to another. For this purpose, a ring metal has one or more binder rings with each ring comprising a pair of complementary shaped ring halves the outer ends of which are movable out of and into contact with each other. The holes in the paper or other material are inserted onto one of the ring halves when the metal is open, held in place when the metal is closed, and removed when the metal is again opened.

A problem with conventional ring metals such as the prior art ring metal shown in FIG. 24, using a conventional trigger such as shown in FIG. 25, is that if they are dropped or otherwise mishandled, the rings of the metal can inadvertently open allowing the contents of the binder to spill out. One approach to preventing this from happening has been to somehow lock the rings in their closed position so even if the binder is jarred, the rings remain closed and the contents secure. Various metal constructions have been developed to achieve locking of the binder rings.

One approach to solving the problem is described in U.S. Pat. Nos. 6,840,695 and 7,674,062, both to Horn, and the Horn published U.S. patent application 2006/0056906. Other recently issued patents which attempt to address the problem include U.S. Pat. No. 7,530,755 which is assigned to the same assignee as the current application, and U.S. Pat. No. 8,186,899 and published U.S. patent application 2012/0230755 both of which are assigned to World Wide Stationery.

While all of the above listed patents work for their intended purpose, the ring metal of the present invention provides a low cost, efficient, and easy to use locking ring metal which is an improvement over currently used locking ring metals.

BRIEF SUMMARY OF THE INVENTION

The present invention is directed to a locking ring metal used in a binder holding hole-punched sheets of paper and the like. The ring metal includes one or more binder rings each of which is formed by a pair of complementary shaped binder ring halves. One end of each ring half is attached to a frame and the frames are movable relative to each other to move the other ends of the associated ring halves out of and into contact with each other so to open and close the ring metal. The frames are installed in a housing having openings through which the respective ring halves extend. A trigger is mounted on one end of the housing. Movement of the trigger produces movement of the frames to open and close the binder ring.

A travel bar is installed in the housing, above the frames. One advantage of the improved ring metal of the present invention is that the travel bar is not connected to the trigger. This simplifies both construction and assembly of the ring metal and saves assembly costs.

The travel bar includes a blocking element which, when in position, overlays the frames to effectively block their movement and lock the binder rings in their closed position. This prevents the ring metal from being inadvertently or accidentally opened.

Another improvement of the ring metal of the present invention is that includes a spring which urges the travel bar in the direction to open rather than close the binder rings. This is contrary to other prior ring metal constructions, but this improvement simplifies operation of the ring metal.

Yet another improvement is that when the binder rings are closed, a small gap exists between the blocking element and the upper surface of the frames. This gap allows for a proper sequencing of movement of the trigger, the travel bar and its associated blocking element, and the binder rings, to efficiently open and close the ring metal.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

FIG. 24 is a perspective view of a prior art ring metal; and,

FIG. 25 is a perspective view of a trigger used on the prior art ring metal.

Corresponding reference characters indicate corresponding parts throughout the several views of the drawings.

DETAILED DESCRIPTION OF INVENTION

Figure 1A:
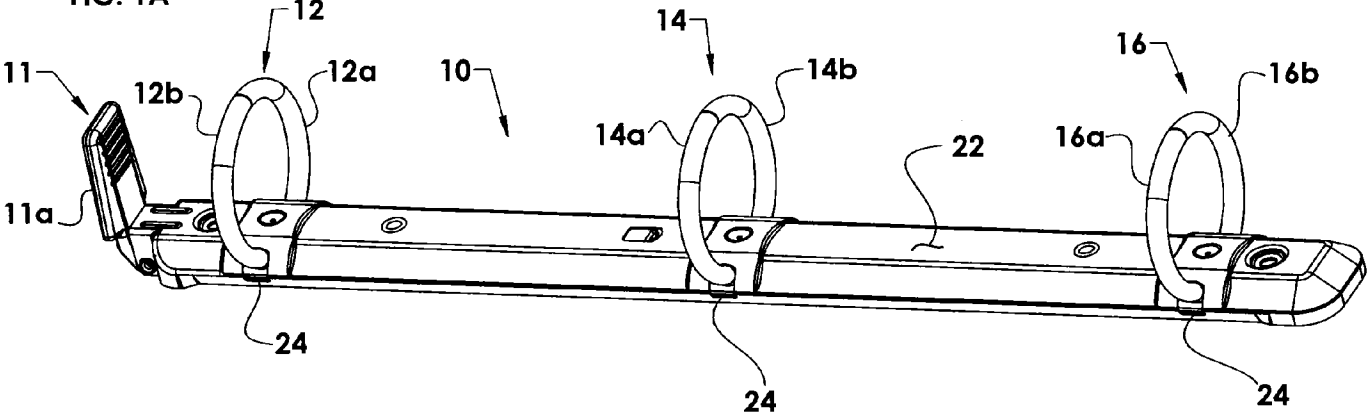
FIG. 1A is a perspective view of an improved locking ring metal of the present invention having a vertically extending trigger.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Figure 1B:
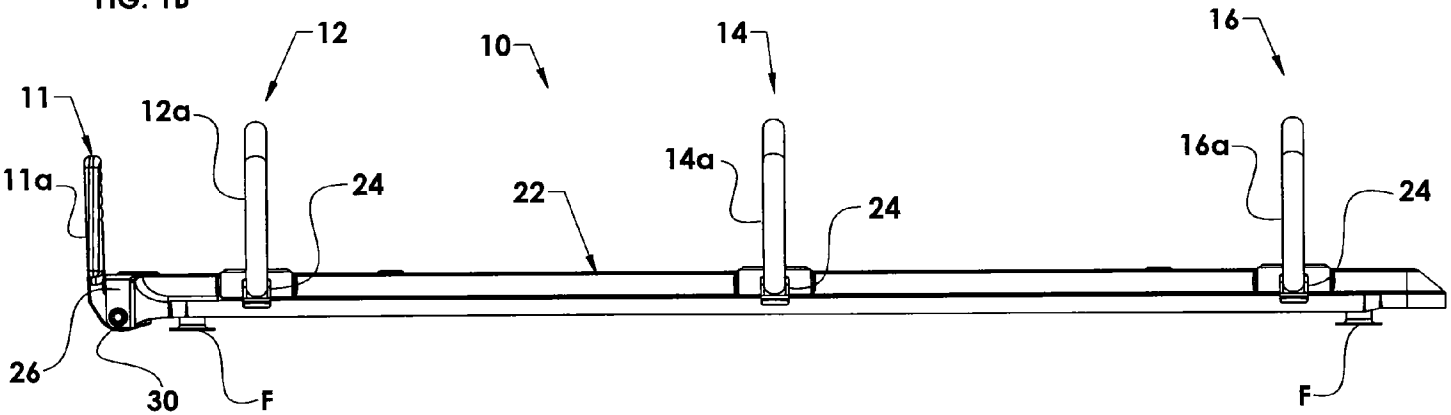
FIG. 1B is an elevation view thereof.
Figure 2A:
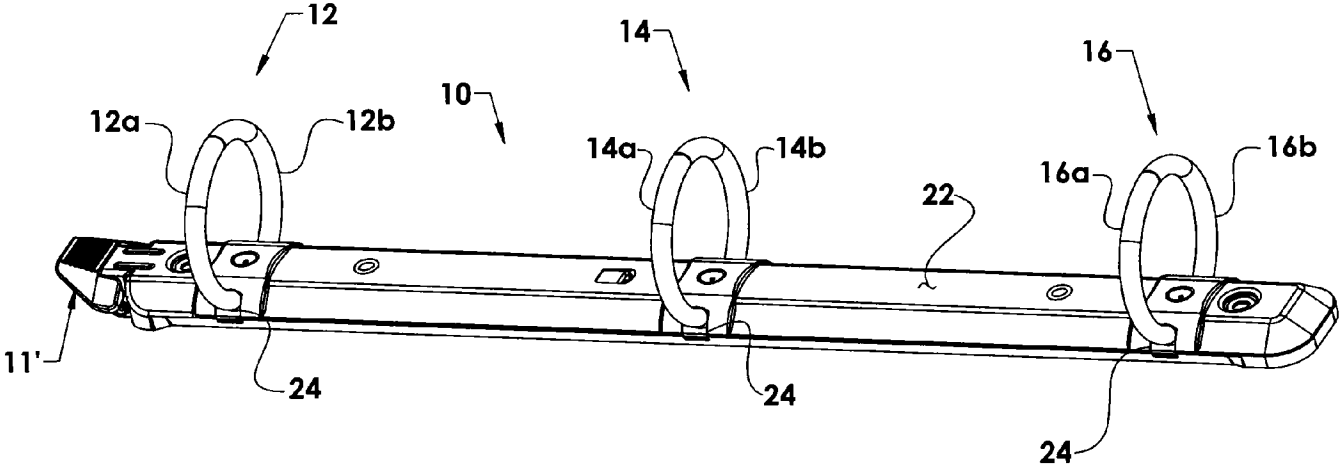
FIG. 2A is a perspective view of an improved locking ring metal of the present invention having a horizontally extending trigger.
Figure 2B:
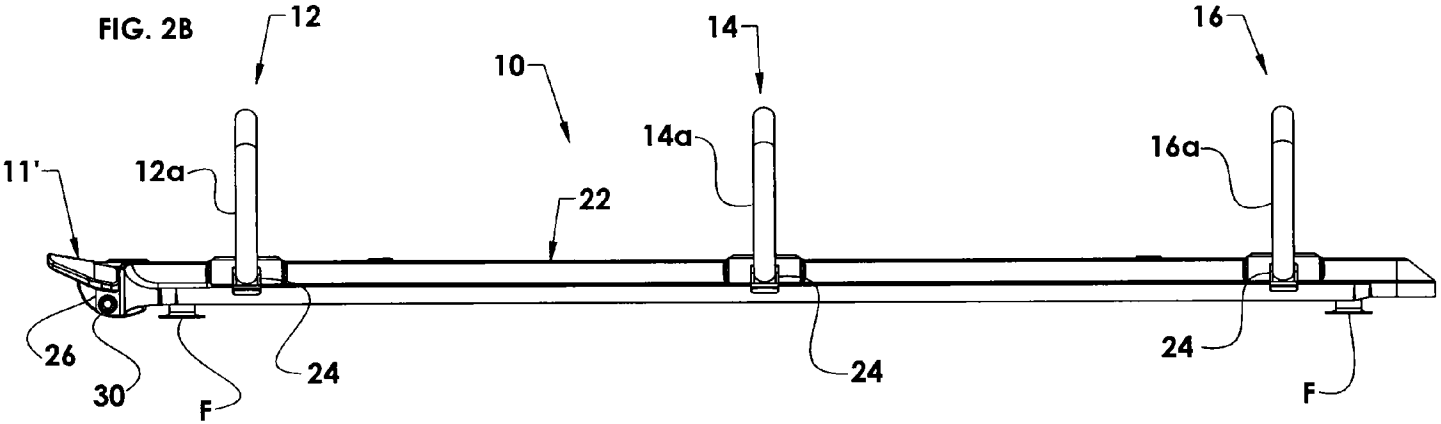
FIG. 2B is an elevation view thereof.
Figure 3:
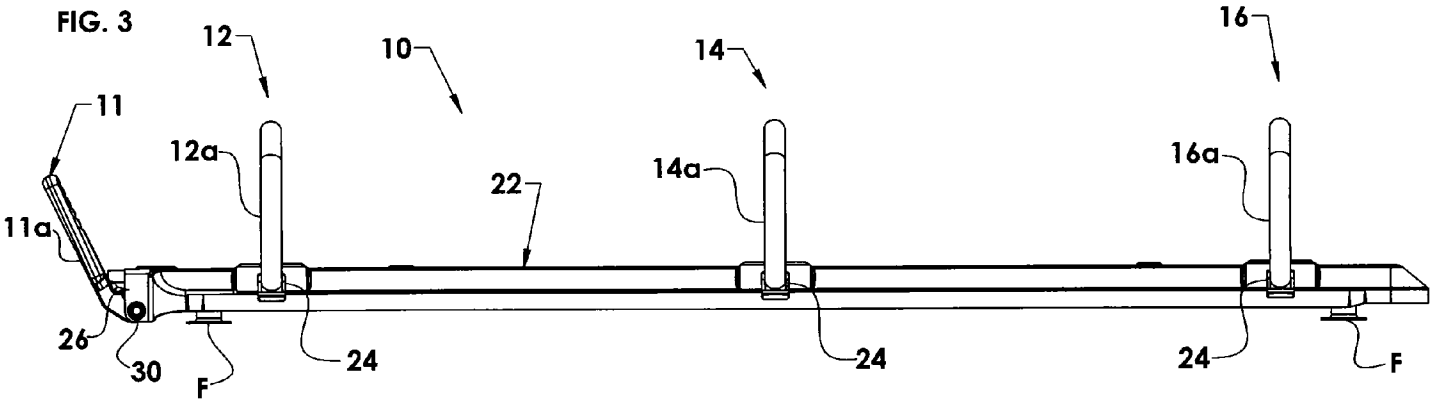
FIG. 3 is a view similar to FIG. 1B in the ring metal open position.
Figure 10:
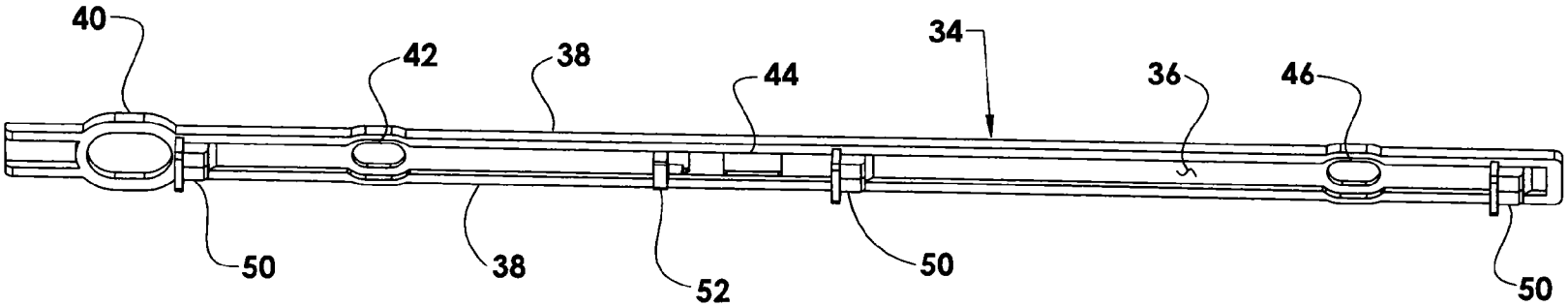
FIG. 10 is a perspective view of a travel bar installed in the ring metal.

Referring to the drawings, a locking ring metal of the present invention for use in a ring binder (not shown) holding hole-punched sheets of paper and the like is indicated generally 10 in FIGS. 1A and 1B, and 10' in FIGS. 2A and 2B. The ring metal 10 or 10' is attached to the spine portion of a binder (not shown) in a conventional manner using fasteners F. Although referred to as a metal or ring metal hereafter, those skilled in the art will understand that metal 10 or 10' can be either of a metal or a plastic construction, or a combination of metal and plastic. The difference between metal 10 and metal 10' is that metal 10 has a vertically extending trigger 11 installed at one end of it; while metal 10' has a horizontally extending trigger 11' installed at that end. The description which follows will be directed at metal 10; although, those skilled in the art will appreciate that the construction and operation of the invention can also be implemented with metal 10'.

Figure 21:
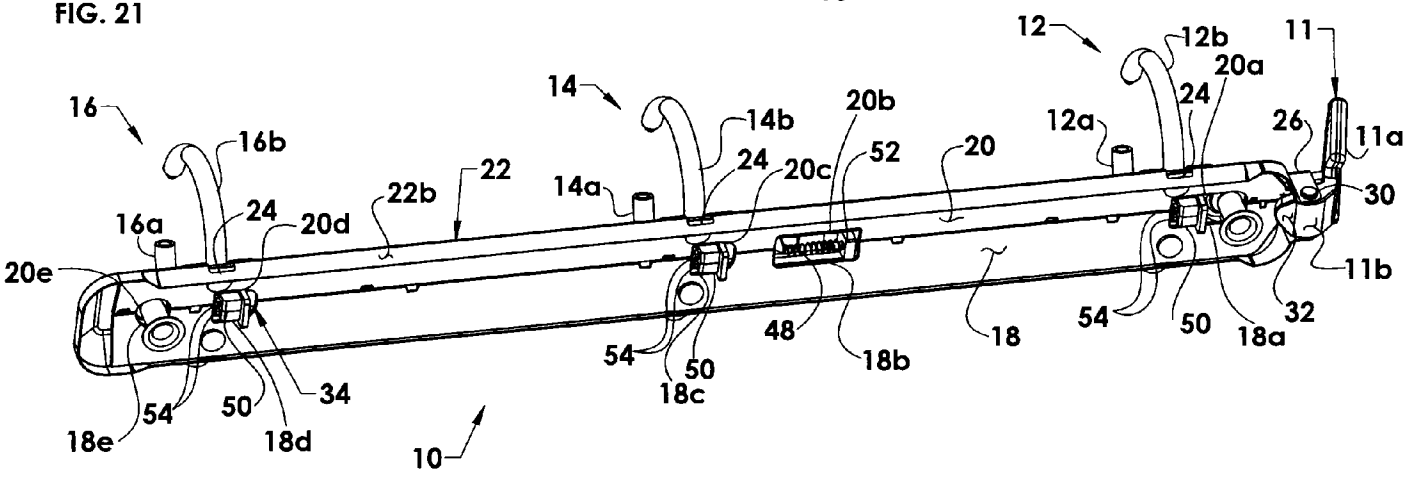
FIG. 21 is a perspective view of the underside of the ring metal when the ring metal is open.
Figure 22:
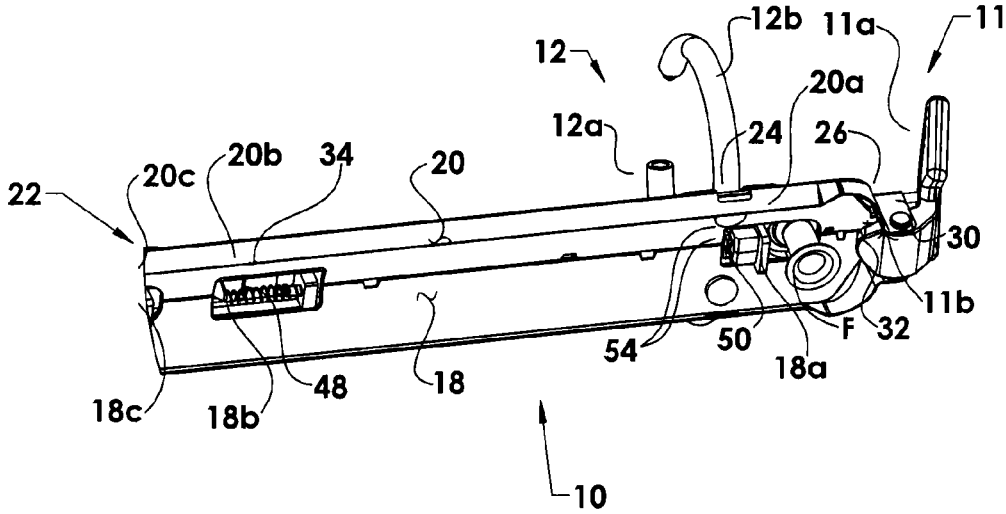
FIG. 22 is an enlarged view of the one end of the ring metal, from the underside thereof, illustrating the position of the trigger and travel bar when the ring metal is open.
Figure 23B:
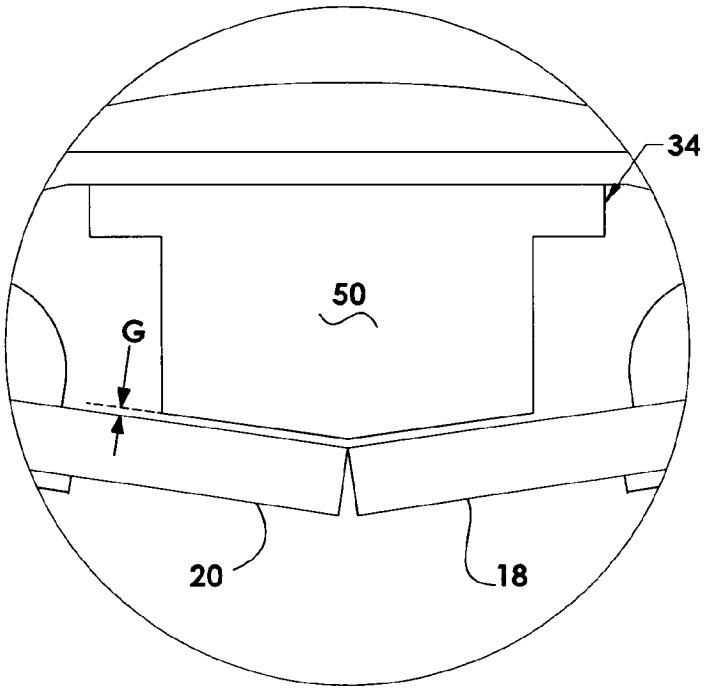
FIG. 23B illustrates the blocking element which extends from the underside of the travel bar and its clearance from the frames when the ring metal is closed.
Figure 23A:
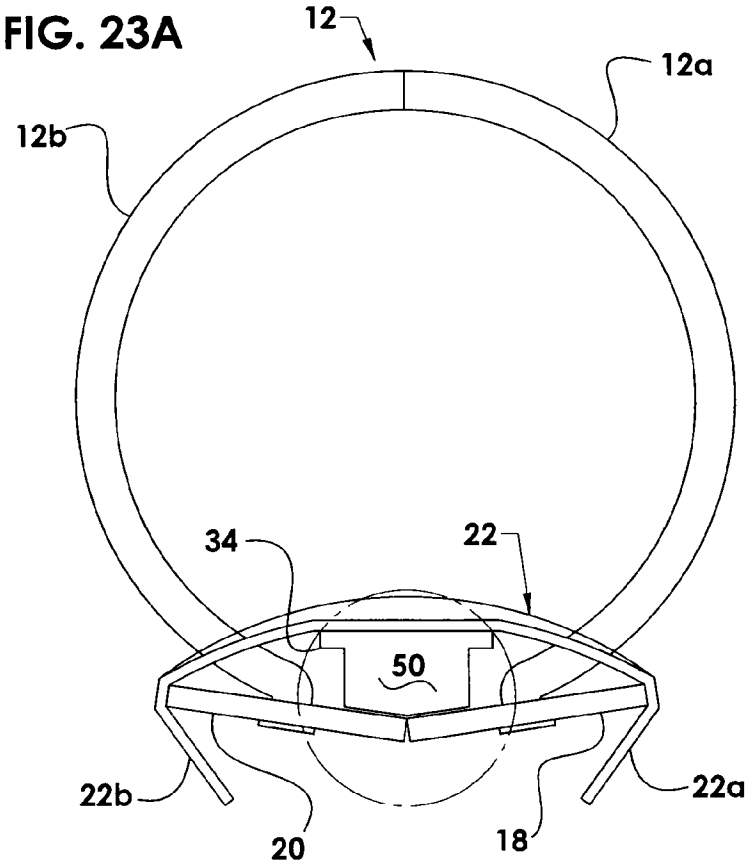
FIG. 23A is a sectional view of the ring metal illustrating the position of the travel bar and frames when the ring metal is closed.

Ring metal 10 includes at least one, and preferably a plurality of binder rings. As shown in the drawings, ring metal 10 includes three spaced rings 12, 14, and 16 each of which is comprised of two complementary curved ring segments 12*a*, 12*b*, 14*a*, 14*b*, and 16*a*, 16*b* respectively. The rings 12 and 16 are located adjacent each end of the ring metal, while ring 14 is located approximately midway the length thereof. Each ring segment has one end attached to a hinge plate or frame 18, 20 respectively. The frames are each a generally rectangular shaped plate and the frames extend side-by-side, parallel to each other, substantially the length of ring metal 10. When the binder rings are closed, the plates are generally flat; although as shown in FIGS. 23A and 23B, the plates angle slightly downwardly from the outside of each frame toward the inner edge thereof. When binder rings 12, 14, 16 are opened, as described herein, frames 18, 20 are flexed as shown in FIGS. 21 and 22. Movement of frames 18, 20 in this regard causes the outer, mating ends of the respective rings to separate from each other and open the binder. Those skilled in the art will understand that ring metal 10 could have more or fewer rings than the rings 12, 14, 16 without departing from the scope of the invention.

Figure 7:
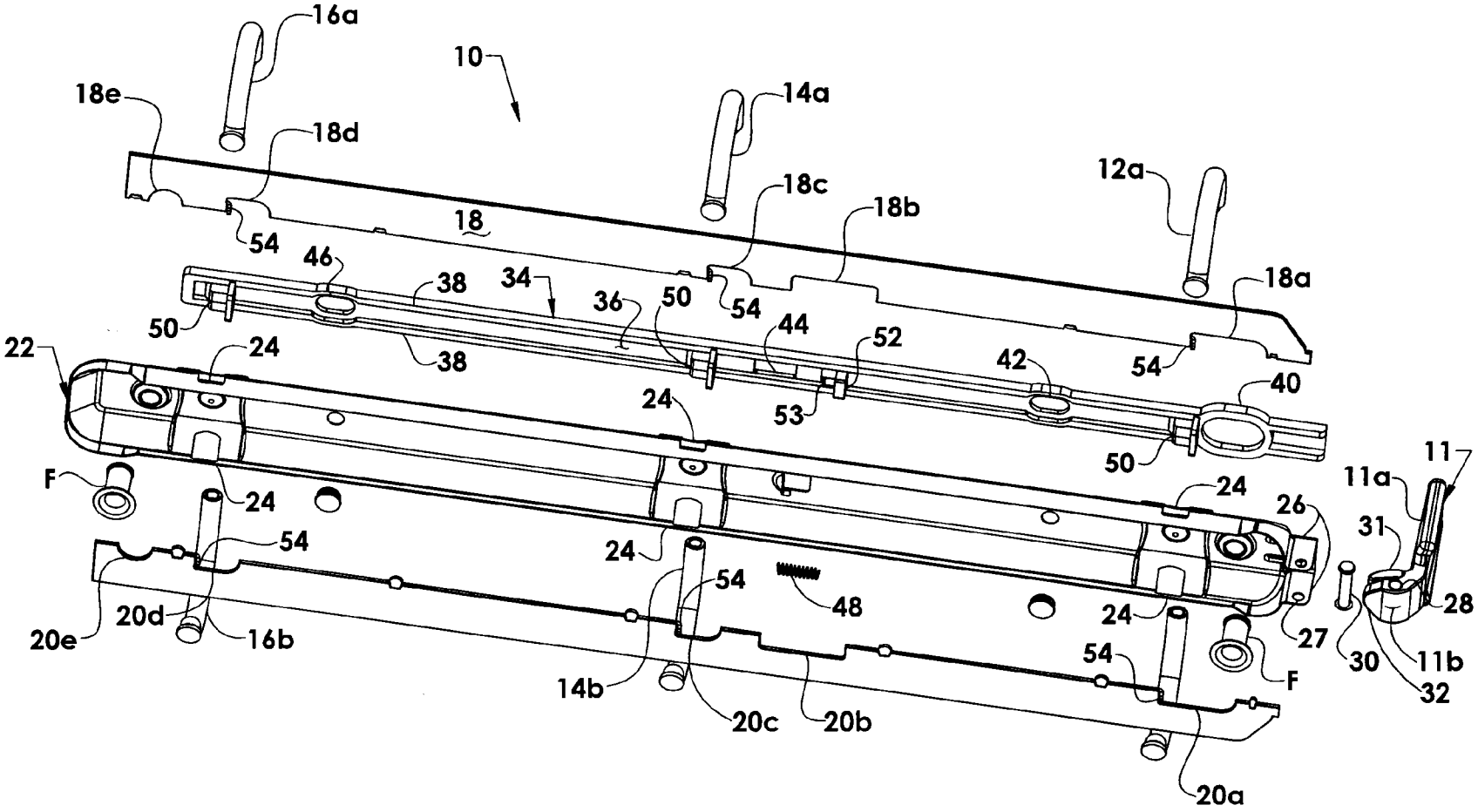
FIG. 7 is an exploded view of the ring metal.
Figure 13:
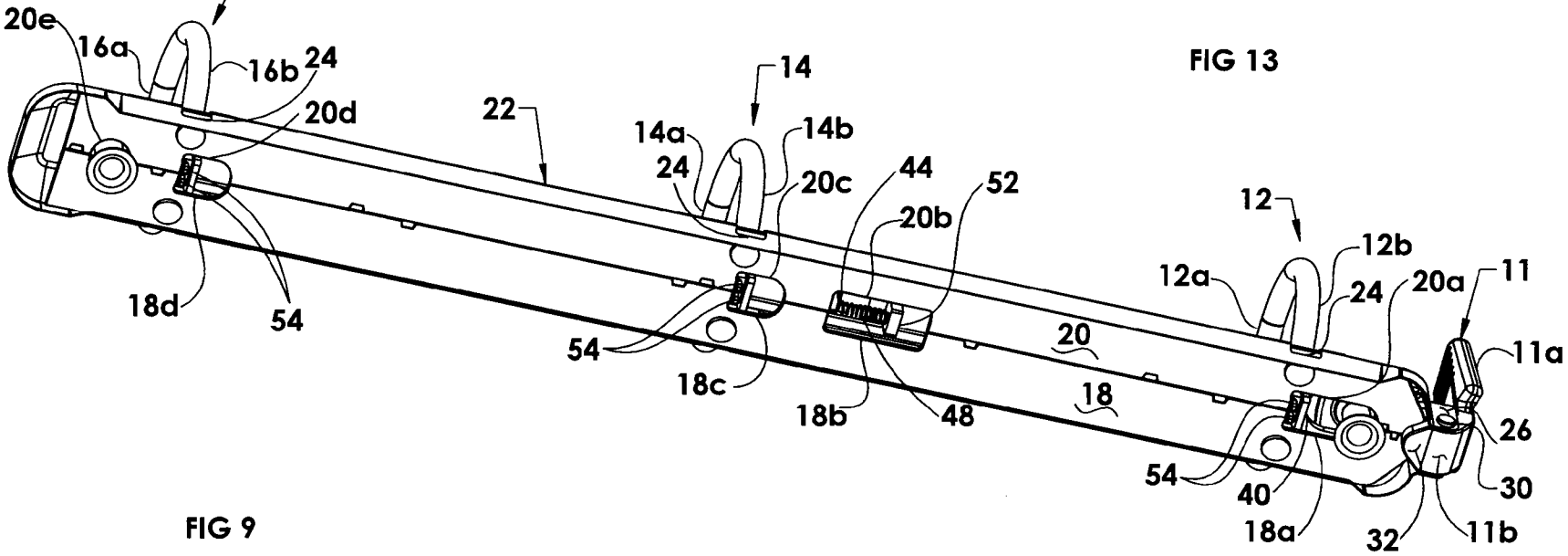
FIG. 13 is a view similar to FIG. 12 but with the frames installed.
Figure 9:
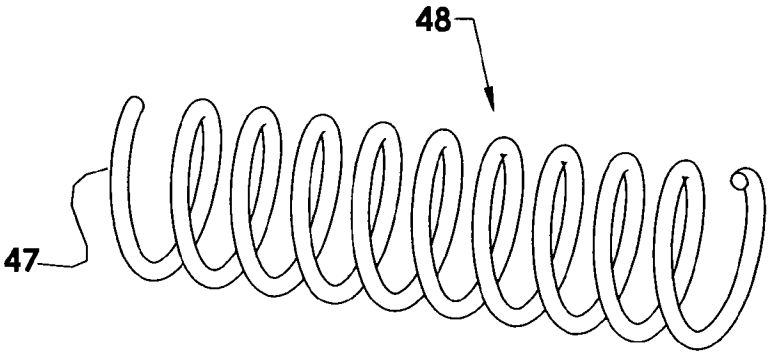
FIG. 9 is a perspective view of a coil spring installed in the ring metal.

As shown in FIG. 7, each of the frames has cutout sections 18*a*-18*e* and 20*a*-20*e* formed along their inner reach. Each of these sections are identical in size and shape with the corresponding cutout section in the other frame. These cutout sections are to accommodate installation of the frames in the ring metal assembly as well as facilitate opening and closing of the binder rings as described hereinafter.

A cover, housing, or shield 22 extends the length of ring metal 10. Frames 18, 20 are installed within cover 22 and the cover has spaced openings 24 along each side through which the respective ring segments extend so to curve up and over the top of the housing. As best shown in FIG. 23A, shield 22 has a curved upper surface with flanks 22*a*, 22*b* that extend downwardly and inwardly from the sides of the shield. The outer edges of frames 18, 20 extend along the length of cover 20 between the upper, curved top surface of the housing and flanks 22*a*, 22*b*. This is as shown in FIG. 23A. Posts F located at each end of the cover extend from the underside of the cover and are used for fastening ring metal 10 to the binder spine using rivets or the like, all as is well-known in the art.

Figure 8:
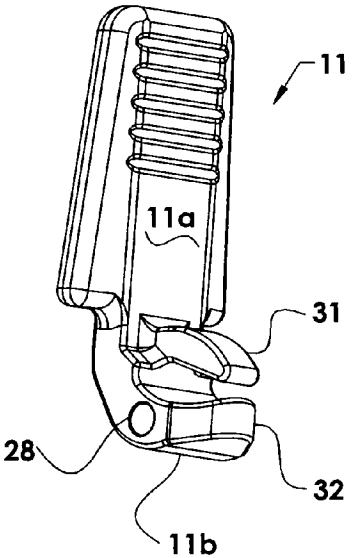
FIG. 8 is a perspective view of a vertically extending trigger installed in the ring metal.
Figure 6:
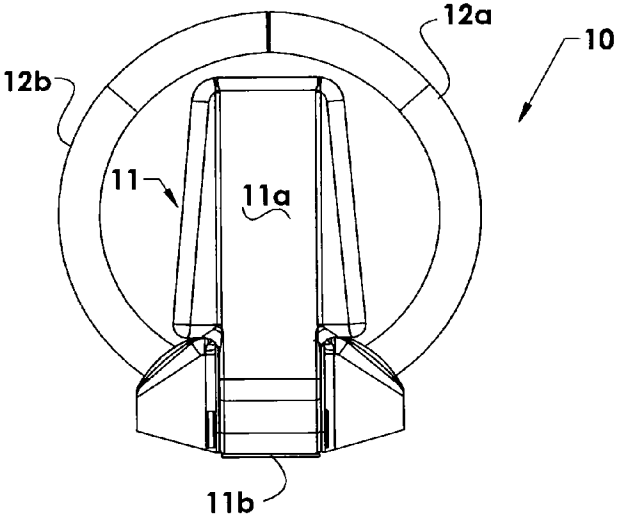
FIG. 6 is an end view of the ring metal in its closed position.

Trigger mechanism 11 is, as previously noted, located at one end of ring metal 10 and is rotatably secured to the ring metal housing. Referring to FIGS. 7 and 8, respective brackets 26 extend downwardly from each side of cover 22 at the one end of the housing where trigger 11 is mounted to the housing. Each bracket has an opening 27 in its lower end. Trigger 11 has a generally vertical or finger pad section 11*a* and a lower, horizontal section 11*b*. A bore 28 extends through section 11*b* and a pin 30 is used to attach trigger 11 to the brackets 26 to install the trigger to cover 10 In operation, pushing against finger pad section 11*a* of trigger 11 causes the trigger to rotate or pivot about pin 30.

Figure 14A:
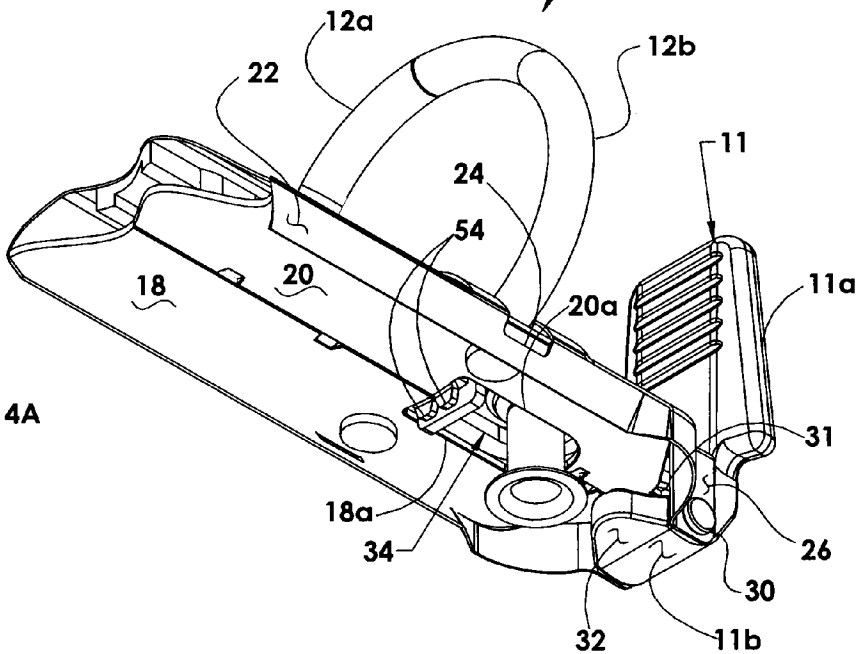
FIG. 14A is a partial view of one end of the ring metal illustrating the position of the trigger and travel bar when the ring metal is closed.
Figure 14B:
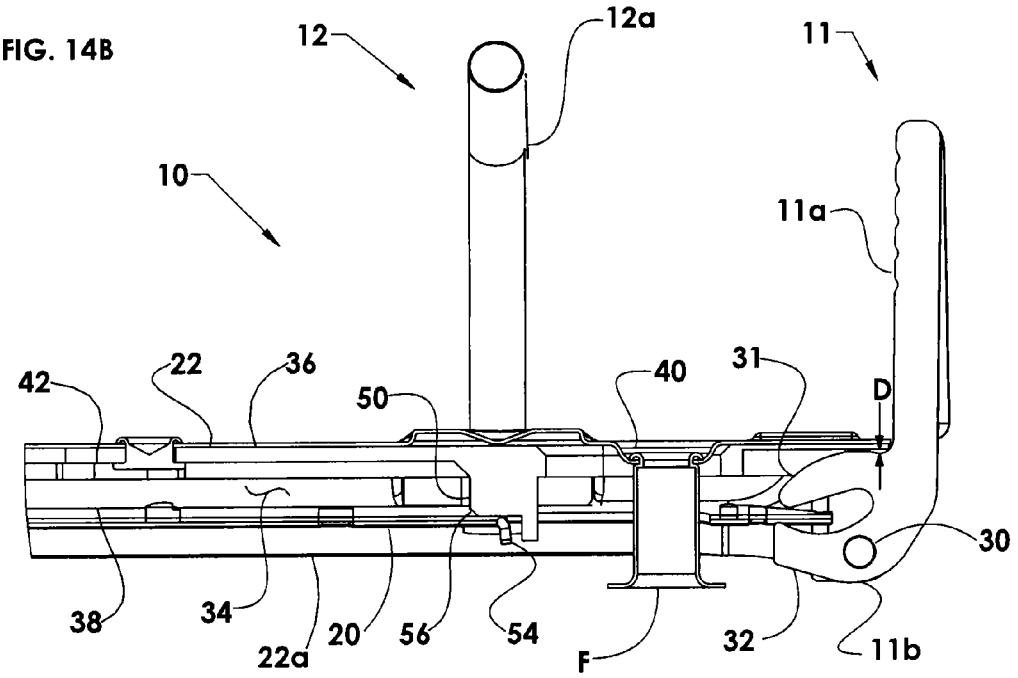
FIG. 14B is an elevation view, partly in section, of this end of the ring metal when it is closed.

Trigger section 11*b* includes an upper horizontally extending projection 31, and a lower horizontally extending projection or tongue 32. When trigger 11 is mounted to housing 22, the ends of the frames 18, 20 at the one end of ring metal 10, are set between projection 31 and tongue 32. This is as shown in FIG. 14B.

Figure 20:
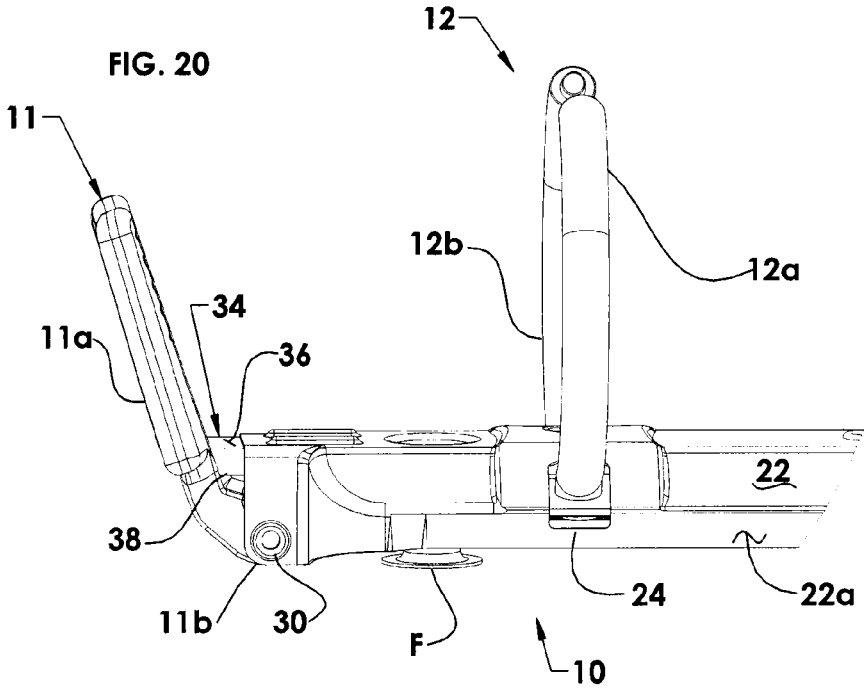
FIG. 20 is an enlarged view of the one end of the ring metal illustrating the position of the trigger and travel bar from another viewpoint when the ring metal is open.

A travel bar indicated generally 34 in the drawings is installed in ring metal 10. Importantly, travel bar 34 is not connected to trigger 11, but rather overlays the frames 18, 20 with its end adjacent the trigger spatially separated from the trigger as shown in FIGS. 14B and 20. The travel bar, which extends substantially the length of housing 22, is installed within the housing beneath the top surface of the cover, and above frames 18, 20 so to overlay the frames. This is as shown in FIGS. 23A and 23B. As described herein, when ring metal 10 is opened, travel bar 34 moves toward trigger 11 even though the travel bar is not connected to the trigger. When metal is fully open, the end of travel bar 34 adjacent trigger 11 overlays projection 31 of the trigger.

Figure 11:
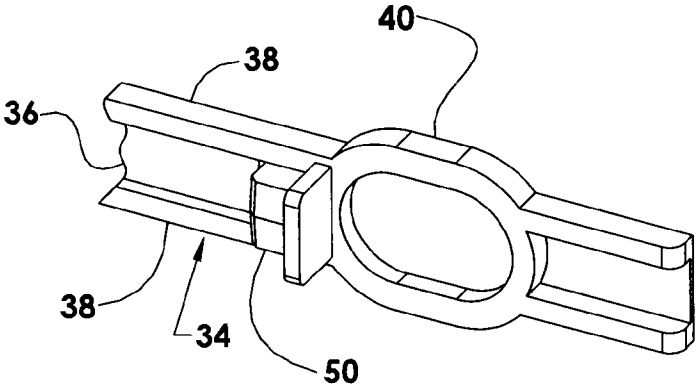
FIG. 11 is an enlarged view of one end of the travel bar.
Figure 12:
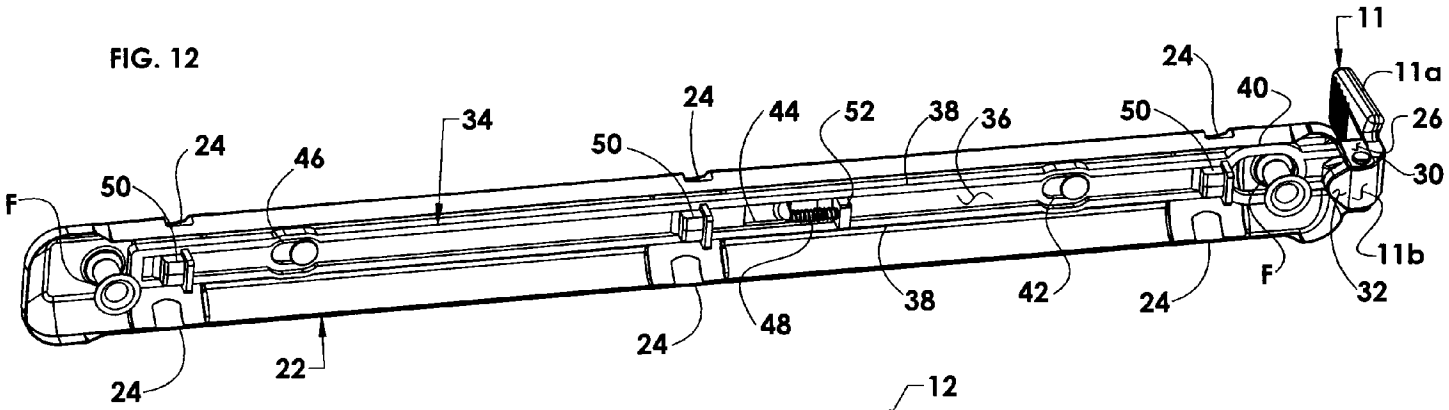
FIG. 12 is a perspective view of the underside of the ring metal without the frames to which ends of the binder rings are attached being installed.
Figure 15B:
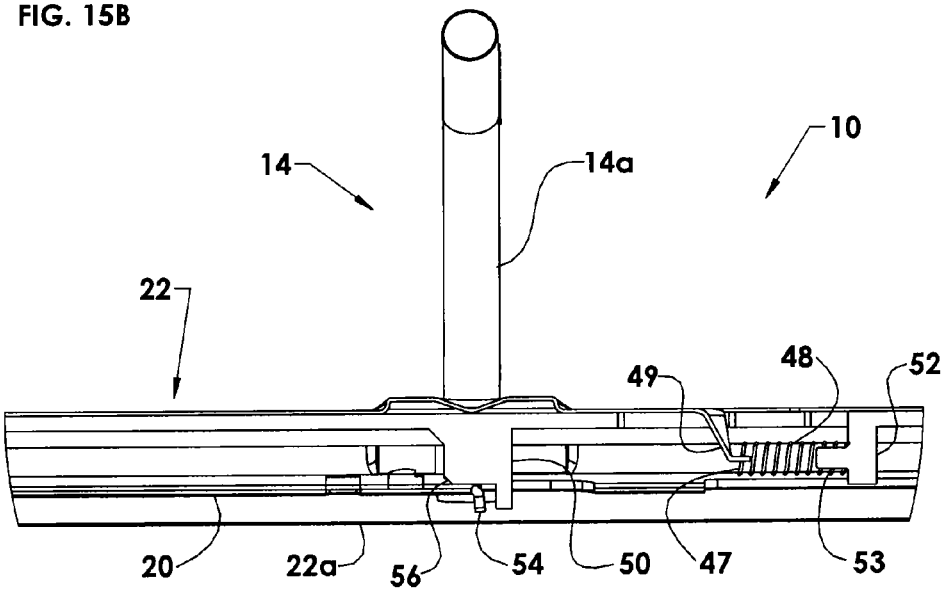
FIG. 15B is an elevation view, partly in section, of a central portion of the ring metal illustrating installation of a spring biasing the travel bar in the direction to open the ring metal.
Figure 15A:
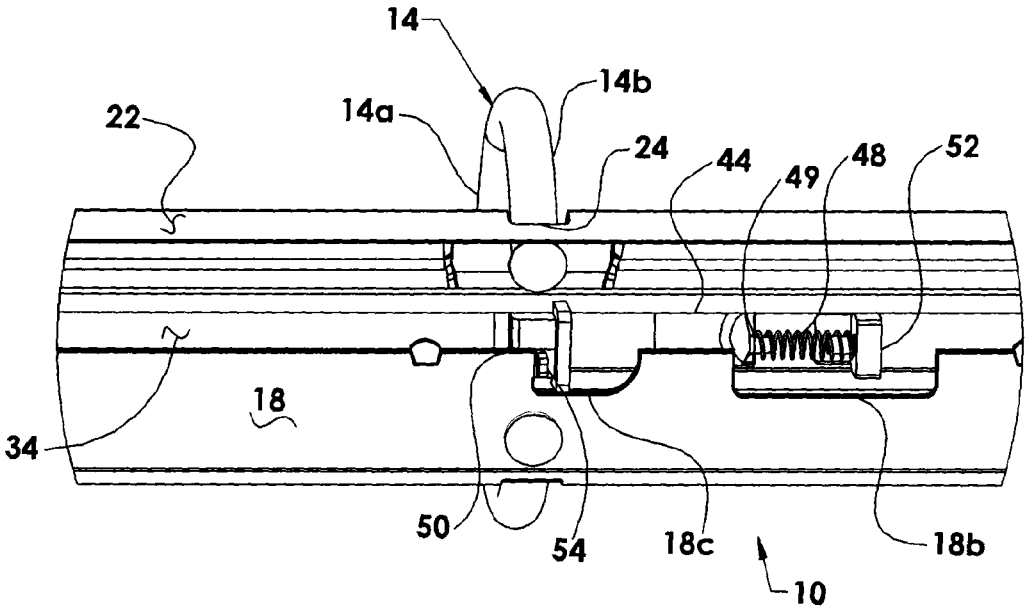
FIG. 15A is an enlarged view of an intermediate portion of the ring metal with one of the frames removed so to illustrate the position of the travel bar when the ring metal is closed.
Figure 16:
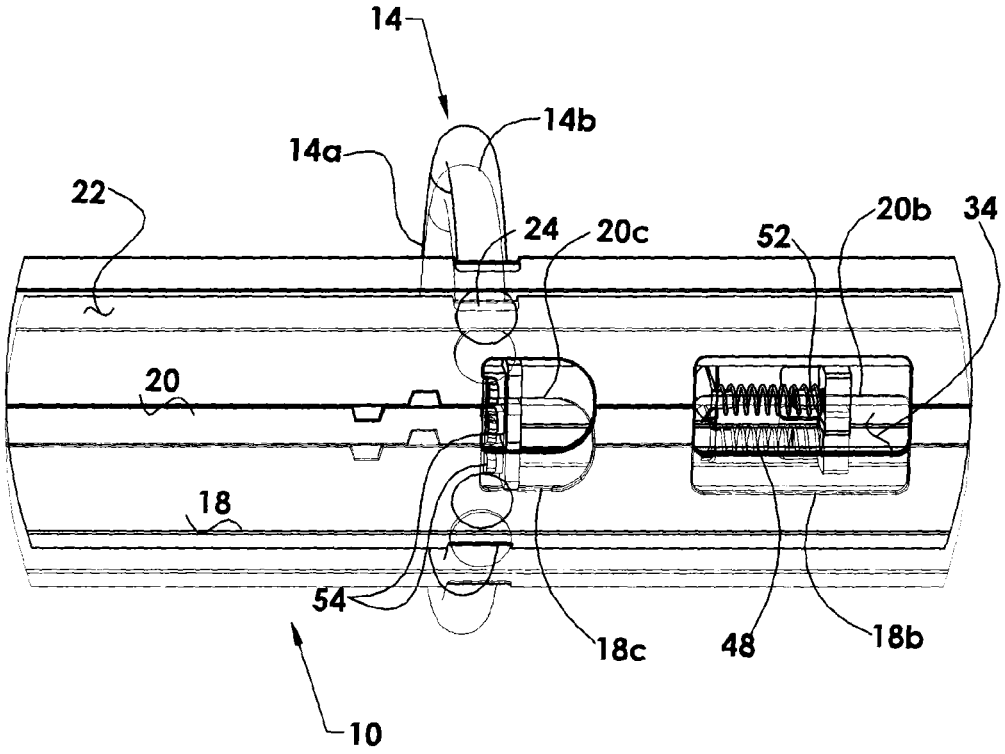
FIG. 16 is a view similar to that of FIG. 15A but with both frames installed.
Figure 17:
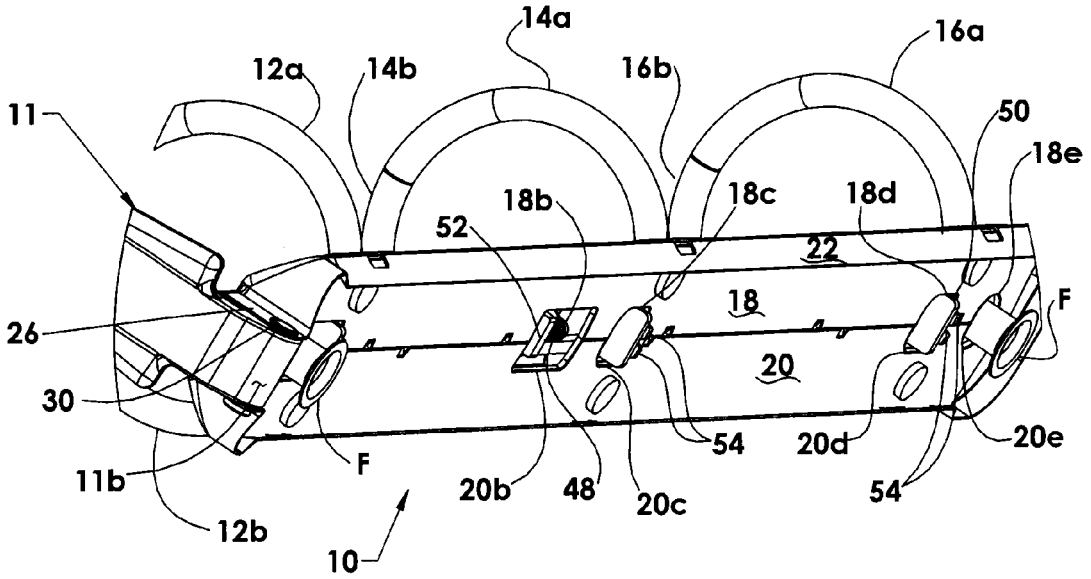
FIG. 17 is an enlarged view of a portion of one end of the ring metal illustrating the position of the travel bar from another viewpoint when the ring metal is closed.
Figure 19:
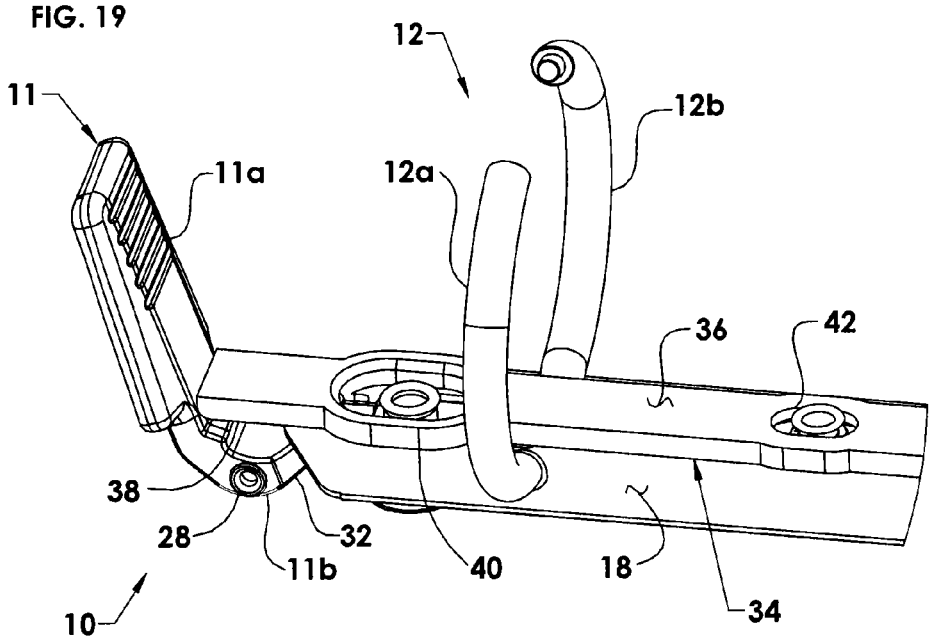
FIG. 19 is an enlarged view of one end of the ring metal illustrating the position of the trigger and travel bar when the ring metal is open.
Figure 18:
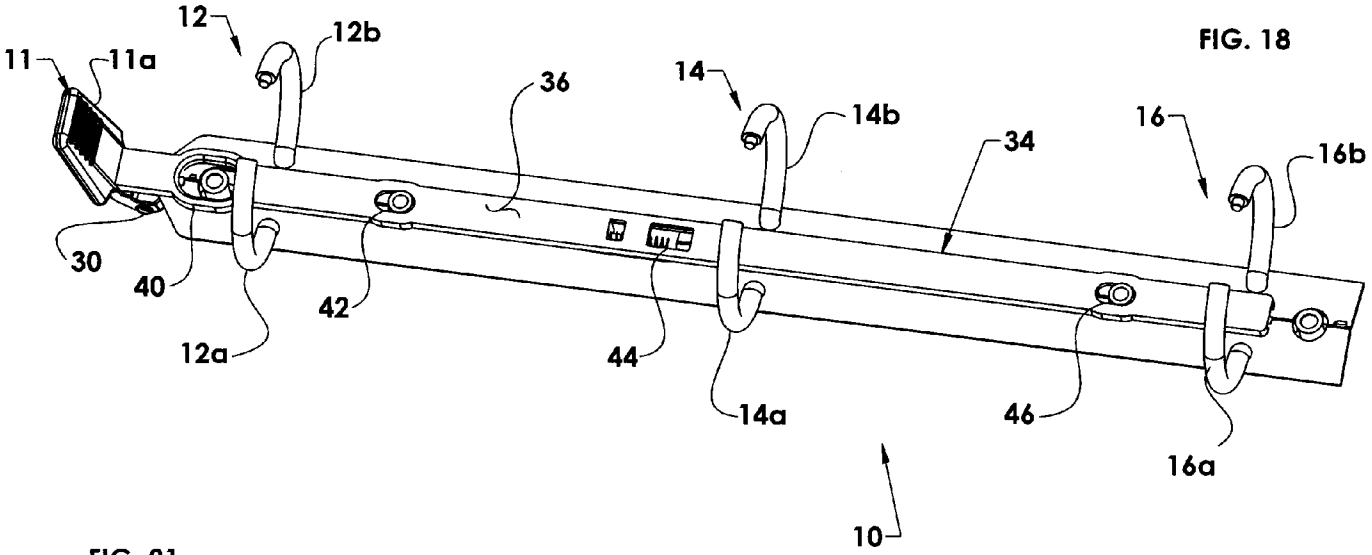
FIG. 18 is a perspective view of the ring metal with its cover removed and illustrating the position of the trigger and travel bar when the ring metal is open.

Referring to FIGS. 7, 10, and 11, travel bar 34 has a top 36 and side rails 38 extending beneath the top of the travel bar along each side thereof and extending the length of the travel bar. The width of travel bar 34 is greater than that of projection 31 of trigger 11. The ends of the side rails adjacent trigger 11 are rounded as shown in FIGS. 10 and 11. Inwardly from this end of travel bar 34, the travel bar as an oval shaped segment 40 which is open in its center. As shown in FIG. 14B, this allows the travel bar to move longitudinally of ring metal 10 about the upper end of the fastener F located at this end of the assembly. The travel bar has additional oval shaped openings 42 and 46 formed at spaced intervals along its length to accommodate movement of the travel bar back and forth underneath housing 22, about the fastener F at the other end of the assembly and protrusions on the underside of the top portion of the cover. The travel bar also has a rectangular shaped opening 44 formed approximately midway along its length for one end 47 of a coil spring 48, which is mounted on travel bar 34, to extend through top surface 36 of the travel bar and seat against a bracket 49 (see FIG. 15B) formed on the underside of the top of cover 22. When spring 48 is mounted as shown in FIG. 15B, the spring biases travel bar 34 to move in the binder ring opening direction.

At least one, and preferably a plurality of spaced blocking elements 50 are formed on the underside of travel bar 34 and overlay frames 18, 20 when ring metal 10 is closed. The location of the respective blocking elements along the length of travel bar 34 is such that they are in approximately the same location as that of each of the rings 12, 14, and 16 when metal 10 is closed. This helps the blocking elements effectively maintain the binder rings closed. As shown in FIG. 14B when ring metal 10 is closed, the lower end of blocking element 50 is positioned immediately above the upper surface of frames 18, 20. As shown in FIG. 23B, in the metal closed position, there is only a slight gap G between these surfaces. The reason for the gap is that it allows for proper sequencing of the movement of the trigger, travel bar, and frames during opening and closing of ring metal 10. However, the size of the gap is so small that any movement of frames 18, 20 in the binder ring opening direction, when ring metal 10 is closed, is effectively prevented by the blocking elements so the rings remain in their closed, locked position.

In addition to blocking elements 50, a vertical plate 52 is also formed on the underside of the travel bar. Plate 52 is located midway along the length of travel bar 34, but spaced from opening 44 in the travel bar as shown in FIG. 7. A post 53 extends from the inner face of plate 52 toward opening 44. The plate is for seating one end of coil spring 48 as shown in the drawings. The other end 47 of the coil spring, as noted, extends through opening 44 and attaches to bracket 49 on the underside of cover 22 so to impart a bias force on the travel bar. Again, this bias force is in the direction to open, not close, ring metal 10 and the binder rings.

Figure 4:
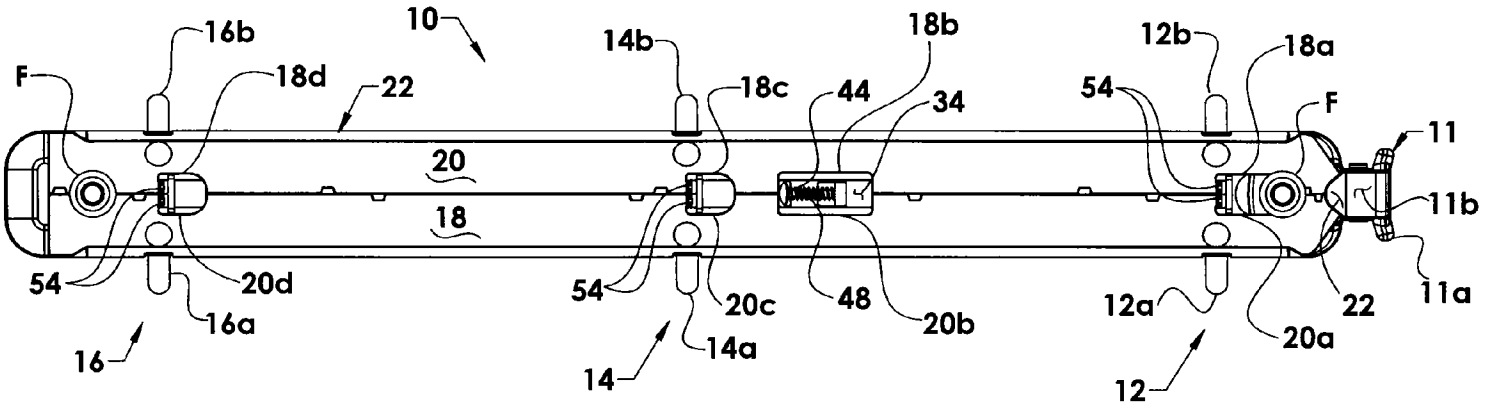
FIG. 4 is a bottom plan view of the ring metal in its closed position.
Figure 5:
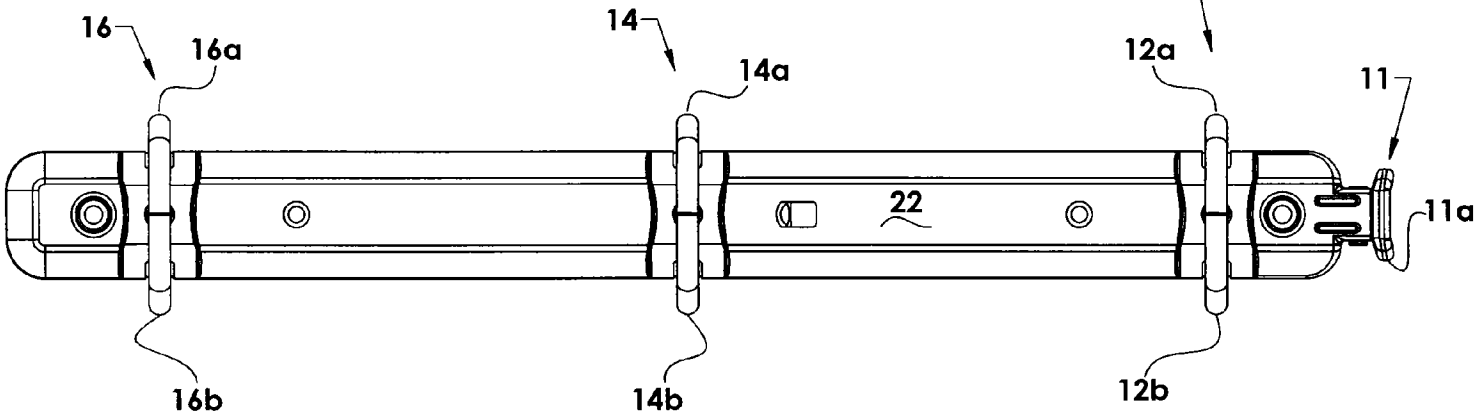
FIG. 5 is a top plan view of the ring metal in its closed position.

Referring to FIG. 4, at one end of the cutout sections 18*a*, 18*c*, 18*d* in frame 18, and the corresponding cutout sections 20*a*, 20*c*, 20*d* in frame 20, identically shaped lips 54 are formed. The lips 54 comprise downwardly extending ramps. These are formed to facilitate opening of binder rings 12, 14, and 16 when metal 10 is opened. As best shown in FIG. 14B, the backside of each blocking element 50 is chamfered as indicated at 56. Now, as travel bar 34 moves toward trigger 11 when the trigger is pressed in the direction to open metal 10, the blocking elements 50 are drawn over the cutout sections 18*a*, 18*c*, 18*d* in frame 18, and the corresponding cutout sections 20*a*, 20*c*, 20*d* in frame 20. As the blocking elements move onto the ramps 54, the ramps facilitate movement of the blocking elements into the openings formed by these cutouts, thereby freeing movement of frames 18, 20 in the binder ring opening direction.

Referring to FIG. 14B, it will be noted that the upper surface of trigger 11 projection 31 is spaced a slight distance D from the underside of top surface 36 of travel bar 34. As with gap G, gap D also allows for proper sequencing of the movement of the trigger, travel bar, and frames during opening and closing of ring metal 10. In operation, when a user presses on the finger pad formed by the front face of trigger section 11*a*, this action pivots trigger 11 about pin 30 by which the trigger is attached to housing 22 of ring metal 10. Continued rotation of trigger 11 brings projection 31 into contact with the travel bar and begins to draw the travel bar toward the right as viewed in FIG. 14B. As the travel bar continues its movement, blocking elements 50 of travel bar 34 are drawn onto and then down the ramps 54 formed at the one end of the cutout sections 18*a*, 18*c*, 18*d* in frame 18, and the corresponding cutout sections 20*a*, 20*c*, 20*d* in frame 20. Now, the blocking elements are no longer positioned over the frames. At the same time this is occurring, tongue 32 of trigger 11 contacts the underside of frames 18, 20 pushing them upwards. As the blocking elements clear the frames, the frames continued movement rotates them upwardly and away from each other moving the outer ends of the respective ring segments away from each other, opening the binder rings 12, 14, 16. During movement of travel bar 34, coil spring 48 urges the travel bar toward trigger 11 in the ring metal opening direction.

The binder rings can also be opened by a user grasping the respective halves of one of the rings 12, 14, 16 and pulling them apart. When this is done, the frames 18, 20 both rotate upwardly against the underside of projection 31 of trigger 11 forcing the trigger to rotate in its binder ring opening direction. Rotation of trigger 11 brings projection 31 into contact with the travel bar, as before, and the travel bar is again drawn toward the right as viewed in FIG. 14B. With continued movement of the travel bar, the blocking elements 50 are drawn onto and then down the ramps 54 formed at the one end of the cutout sections 18*a*, 18*c*, 18*d* and 20*a*, 20*c*, 20*d* of the respective frames 18, 20. Again, the blocking elements are no longer positioned over the frames. Rotation of trigger 11 further brings its tongue 32 into contact with the underside of frames 18, 20 which helps push them upwards. As the blocking elements clear the frames, the frames rotate upwardly and away from each other so to move the outer ends of the respective ring segments away from each other and opening the ring metal. During this movement of the travel bar, coil spring 48 again urges travel bar 34 toward trigger 11 in the ring metal opening direction.

When the binder rings of ring metal 10 are to be closed, a user pushes trigger section 11*a* in the opposite direction. In doing so, projection 31 of the trigger now bears against the upper surfaces of frames 18, 20 mechanically forcing them in a downward direction. This action also mechanically forces travel bar 34 to move in the direction away from trigger 11, this movement being against the opening force provided by spring 48. Continued movement of the travel bar moves blocking elements 50 back toward their original positions in which they again overlay frames 18, 20 locking the frames in their binder ring closed position.

Alternately, the user can press the separated sections of one the rings 12, 14, 16 back together. This movement pivots frames 18, 20 back toward their original position. In doing so, the underside of the frames push downwardly against tongue 32 of trigger 11 forcing the trigger back toward its original metal ring 10 closed position. This action further forces travel bar 34 to move in the direction away from trigger 11 to close the ring metal; which force is against the opening force provided by spring 48. Continued movement of the travel bar moves blocking elements 50 back toward their original positions overlaying frames 18, 20 locking the frames in their binder ring closed position.

In view of the above, it will be seen that the several objects and advantages of the present disclosure have been achieved and other advantageous results have been obtained.

Having thus described the invention, what is claimed and desired to be secured by Letters Patent is:

1. A locking ring metal for a binder holding hole-punched sheets of paper, comprising:

at least one binder ring formed by a pair of complementary shaped binder ring halves;

a pair of frames, one end of each ring half being attached to a respective one of the frames, the frames being movable relative to each other to move the other ends of the ring halves out of and into contact with each other so as to open and close the binder ring;

a housing in which the frames are installed;

a trigger mounted on one end of the housing for moving the frames to open and close the binder ring; and, a travel bar installed within the housing above the frames, the travel bar contacting the trigger but not connected to the trigger or any other element intermediate the travel bar and the trigger and with no portion of the travel bar being received into any portion of the trigger, the travel bar including a blocking element which overlays the frames and, when in position, prevents movement of the frames in a direction to open the binder ring so as to lock the binder ring closed.

2. The locking ring metal of claim 1 further including a spring attached to the travel bar and urging the travel bar in a direction which moves the blocking element to a position that allows the frames to move to open the binder ring.

3. The locking ring metal of claim 2 in which the trigger forms a lever and movement of the lever to open the binder ring brings the lever into contact with the travel bar with continued movement of the lever to open the binder ring moving the travel bar to a position in which the blocking element no longer prevents movement of the frames for the frames to move in the direction to open the binder ring.

4. The locking ring metal of claim 3 in which the frames extend longitudinally of the housing in a side-by-side arrangement and, when the ring metal is closed, the blocking element overlays both frames to block movement of the frames to open the binder ring.

5. The locking ring metal of claim 4 in which there is a gap between the blocking element and each of the frames when the binder ring is closed, the gap allowing for proper sequencing of the movement of the trigger, travel bar, and frames during opening and closing of the ring metal.

6. The locking ring metal of claim 5 in which corresponding openings are formed in each frame with the blocking element spaced from the openings when the binder ring is closed, movement of the travel bar by the lever when the lever is moved to open the binder ring drawing the blocking element into one set of the openings thereby allowing the frames to move to open the binder ring.

7. The locking ring metal of claim 1 including a plurality of spaced binder rings each formed by complementary binder ring halves one end of each of which is attached to one of the frames for movement of the trigger to effect opening of all the binder rings.

8. The locking ring metal of claim 7 in which the travel bar has a plurality of blocking elements located along the length of the travel bar and overlaying the frames when the binder rings are closed.

9. The locking ring metal of claim 8 in which the blocking elements are located adjacent the location of the respective binder rings when the binder rings are closed.

10. The locking ring metal of claim 9 in which corresponding openings are formed in each frame with each blocking element spaced from one end of one of the openings when the binder ring is closed, movement of the travel bar by the trigger when the trigger is moved to open the binder rings drawing each blocking element into a corresponding opening so to allow the frames to move to open the binder rings.

11. The locking ring metal of claim 10 in which a ramp is formed on each frame adjacent one end of an opening for a corresponding blocking element to be drawn into the opening by movement of the travel bar in the binder rings' opening direction.

12. The locking ring metal of claim 11 in which a surface of each blocking element which moves over the frames is chamfered to facilitate movement of the blocking element down the ramp and into an opening when the travel bar moves in the binder rings' opening direction, thereby enabling the frames to rotate in a direction to open the binder rings.

13. The locking ring metal of claim 5 in which the trigger includes a projection which extends over one end of the frames and a tongue which extends beneath said end of the frames, there being a gap between the frames and the projection and tongue, said gap allowing for proper sequencing of the movement of the trigger, travel bar, and frames during opening and closing of the ring metal.

14. The locking ring metal of claim 13 in which, when the ring metal is to be opened, movement of the trigger brings the tongue into contact with an underside of the frames for continued movement of the trigger to move the frames in a direction to open the binder ring.

15. The locking ring metal of claim 14 in which, when the ring metal is to be closed, movement of the trigger brings the projection into contact with an upper surface of the frames for continued movement of the lever to move the frames in an opposite direction to close the binder ring.

16. A locking ring metal for a binder holding hole-punched sheets of paper comprising:

a plurality of binder rings spaced along the length of the ring metal, each ring being formed by a pair of complementary shaped binder ring halves;

a pair of frames, one end of each ring half being attached to a respective one of the frames, the frames being movable relative to each other to move the other ends of the ring halves out of and into contact with each other so as to open and close the binder rings;

a housing in which the frames are installed;

a trigger mounted on one end of the housing for moving the frames to open and close the binder rings;

a travel bar installed within the housing above the frames, the travel bar contacting the trigger but not connected to the trigger or any other element intermediate the travel bar and the trigger and with no portion of the travel bar being received into any portion of the trigger, the travel bar including a blocking element overlaying the frames and which, when in position, prevents movement of the frames in a direction to open the binder rings so to lock the binder rings in their closed position; and, a spring attached to the travel bar and urging the travel bar in the binder rings' opening direction.

17. The locking ring metal of claim 16 in which the travel bar has a plurality of blocking elements located along the length of the travel bar and overlaying the frames so to effectively block movement of the frames and lock the binder rings closed.

18. The locking ring metal of claim 17 in which corresponding openings are formed in each frame with each blocking element spaced from one end of one of the openings when the binder ring is closed, movement of the travel bar by the trigger when the trigger is moved to open the binder rings drawing each blocking element into an associated opening so as to allow the frames to move to open the binder rings.

19. The locking ring metal of claim 18 in which a ramp is formed on each frame adjacent each end of an opening in the frame into which a blocking element is drawn by movement of the travel bar so to effect movement of the blocking element into the opening, a surface of each blocking element being chamfered to facilitate movement of the blocking element down the ramp and into the opening thereby enabling the frames to rotate in a direction to open binder rings.

20. The locking ring metal of claim 16 in which the trigger includes a projection extending over one end of the frames when the ring metal is closed and a tongue which extends beneath said end of the frames, there being a gap between the frames and the projection and tongue, the gap allowing for proper sequencing of the movement of the trigger, travel bar, and frames during opening and closing of the ring metal, movement of the trigger when the ring metal is to be opened bringing the tongue into contact with an underside of the frames for continued movement of the trigger to move the frames in a direction to open the binder ring; and, when the ring metal is to be closed, movement of the trigger bringing the projection into contact with an upper surface of the frames for continued movement of the trigger to move the frames in an opposite direction to close the binder ring.

* * * * *